US007544288B1

(12) United States Patent
Cook

(10) Patent No.: US 7,544,288 B1
(45) Date of Patent: Jun. 9, 2009

(54) GUTTER FILTERING DEVICE

(76) Inventor: Michael Cook, 165 Highland Ave., Northport, NY (US) 11768

( * ) Notice: Subject to any disclaimer, the term of this patent is extended or adjusted under 35 U.S.C. 154(b) by 0 days.

(21) Appl. No.: 12/152,769

(22) Filed: May 16, 2008

(51) Int. Cl.
*E04D 13/00* (2006.01)

(52) U.S. Cl. ..... 210/162; 210/150; 210/151; 210/251; 55/12; 261/94

(58) Field of Classification Search ..... 52/12
See application file for complete search history.

(56) References Cited

U.S. PATENT DOCUMENTS

| | | | | | |
|---|---|---|---|---|---|
| 316,578 | A | | 4/1885 | Schumann et al. | |
| 428,581 | A | | 5/1890 | Wock | |
| 535,656 | A | | 3/1895 | Andrews | |
| 1,011,669 | A | * | 12/1911 | Temme | 138/32 |
| D54,617 | S | | 3/1920 | Haven | |
| 1,483,165 | A | | 2/1924 | Eaton | |
| 1,811,728 | A | * | 6/1931 | McKee | 210/463 |
| D122,817 | S | * | 10/1940 | Ford | D23/209 |
| 2,597,704 | A | | 5/1952 | Carlson | |
| D167,285 | S | | 7/1952 | Schmid | |
| 2,640,593 | A | | 6/1953 | Korb | |
| D187,205 | S | | 2/1960 | Laughlin | |
| 3,087,233 | A | * | 4/1963 | Turnbull | 428/605 |
| 3,121,684 | A | * | 2/1964 | Bugbird | 210/237 |
| 3,151,962 | A | * | 10/1964 | O'Dell | 55/350.1 |
| 3,364,656 | A | | 1/1968 | Whiton | |
| 3,409,138 | A | | 11/1968 | Lawrence | |
| 3,681,925 | A | * | 8/1972 | Schumnk et al. | 405/49 |
| 3,758,087 | A | | 9/1973 | Hoon, Jr. | |
| D232,236 | S | | 7/1974 | Borde | |
| D232,237 | S | | 7/1974 | Borde | |
| D232,238 | S | | 7/1974 | Borde | |
| 3,823,924 | A | | 7/1974 | Hoon, Jr. | |
| 3,855,132 | A | * | 12/1974 | Dugan | 210/455 |
| D235,870 | S | | 7/1975 | Sheehan | |
| 4,245,924 | A | * | 1/1981 | Fouss et al. | 405/45 |
| 4,272,370 | A | | 6/1981 | Cunning | |
| 4,285,812 | A | * | 8/1981 | Stoltz | 210/162 |
| 4,523,613 | A | * | 6/1985 | Fouss et al. | 138/121 |
| 4,949,514 | A | * | 8/1990 | Weller | 52/12 |
| 4,964,247 | A | * | 10/1990 | Spica | 52/12 |
| 5,103,601 | A | * | 4/1992 | Hunt | 52/12 |
| 5,107,635 | A | * | 4/1992 | Carpenter | 52/12 |
| D331,793 | S | | 12/1992 | Erwes | |
| D338,725 | S | | 8/1993 | Trampush | |
| 5,242,591 | A | * | 9/1993 | Beechert et al. | 210/474 |
| 5,409,602 | A | | 4/1995 | Sorenson | |
| 5,535,554 | A | * | 7/1996 | Harris Jr. | 52/12 |
| 5,536,406 | A | | 7/1996 | Silva | |
| 5,595,027 | A | * | 1/1997 | Vail | 52/12 |
| D390,924 | S | * | 2/1998 | Schlatter | D23/267 |
| D395,072 | S | * | 6/1998 | Mariani | D23/209 |
| 5,791,091 | A | * | 8/1998 | Barbera | 52/12 |
| 5,852,900 | A | * | 12/1998 | Edelman | 52/12 |
| RE36,343 | E | * | 10/1999 | Silva | 210/460 |
| 5,960,590 | A | * | 10/1999 | Hutchison | 52/11 |
| D417,264 | S | * | 11/1999 | Beth | D23/261 |
| 5,989,357 | A | * | 11/1999 | Vilhauer et al. | 134/8 |

(Continued)

*Primary Examiner*—Robert James Popovics
(74) *Attorney, Agent, or Firm*—John P. McGonagle

(57) ABSTRACT

A filter sphere for preventing debris from entering a downspout of a rain gutter. The filter sphere is a hollow, perforated sphere with a diameter slightly less than the width of a normal rain gutter.

7 Claims, 3 Drawing Sheets

U.S. PATENT DOCUMENTS 6,035,580 A * 3/2000 Carter ..... 52/12
D425,182 S * 5/2000 Vargas ..... D23/260
6,141,916 A * 11/2000 Shackelford ..... 52/12
6,193,880 B1 2/2001 Bergeron
6,223,474 B1 * 5/2001 Kafton ..... 52/12
6,225,600 B1 * 5/2001 Burris ..... 219/213
6,282,845 B1 * 9/2001 Hines ..... 52/12
6,293,054 B1 * 9/2001 Cangialosi ..... 52/12
6,307,526 B1 6/2002 Saul et al.
6,397,526 B1 * 6/2002 Saul et al. ..... 52/16
6,652,112 B1 * 11/2003 Lucarelli ..... 362/145
6,932,911 B1 * 8/2005 Groth et al. ..... 210/747
7,014,175 B2 3/2006 Honnell
7,051,480 B1 * 5/2006 Dennis ..... 52/24
7,174,676 B1 * 2/2007 Armstrong ..... 52/11
7,200,969 B2 4/2007 Rotter
7,208,081 B2 * 4/2007 Jones ..... 210/162
D550,804 S * 9/2007 Jones ..... D23/209
7,303,687 B2 * 12/2007 Groth et al. ..... 210/747
7,469,504 B2 * 12/2008 Nocella ..... 52/12
2002/0073631 A1 * 6/2002 Baker ..... 52/12
2004/0040220 A1 * 3/2004 Baker ..... 52/12
2005/0016078 A1 * 1/2005 Rotter ..... 52/12
2005/0034376 A1 * 2/2005 Pourdeyhimi et al. ..... 52/11
2005/0145560 A1 * 7/2005 Jones ..... 210/459
2005/0178072 A1 * 8/2005 Olthoff ..... 52/12
2005/0247611 A1 * 11/2005 Groth et al. ..... 210/162
2006/0037253 A1 * 2/2006 Mozeika ..... 52/12
2006/0086672 A1 4/2006 Goliszewski
2006/0117672 A1 * 6/2006 Kurple et al. ..... 52/12
2006/0191208 A1 8/2006 MacIntyre
2006/0291963 A1 * 12/2006 Theisen et al. ..... 405/302.7
2007/0175106 A1 8/2007 Rotter
2008/0066391 A1 * 3/2008 Rademacher ..... 52/12
2009/0071596 A1 * 3/2009 Theisen et al. ..... 156/189

* cited by examiner

GUTTER FILTERING DEVICE

BACKGROUND OF THE INVENTION

This invention relates to rain gutters and downspouts, and in particular, to a filtering device for separating debris from rain water.

Drains and gutters are used to channel the flow of water from houses and buildings thereby avoiding water damage. The roofs of houses and buildings commonly incorporate rain gutters and eaves troughs with downspouts that collect and redirect rain water, and empty the gutters and troughs through downspouts.

Water flow through the gutters and troughs often contain large particles or debris such as leaves, small branches, sediment, and the like, which tend to gather at the downspouts. As the water washes down into the downspouts, the leaves and larger debris can create clogs either over the downspout inlets, and/or within the downspouts themselves. This restricts and even blocks drainage through the downspouts. As backed up water overflows the house/building drainage system water damage may then occur, not only to the drainage system, but to the house or building structure itself.

Many types of devices are known in the prior art for preventing rain gutters and downspouts from becoming clogged with leaves and other debris. All of the prior art devices require installation in the drainage system. This involves climbing a ladder and performing roofing/carpentry functions at a dangerous height. While this is within the normal work scope of a professional roofer or carpenter, it is not an easy task for the average homeowner.

Accordingly, there is a need for a filtering device which is simple to install and effective in filtering debris from rain water.

SUMMARY OF THE INVENTION

It is a primary object of this invention to provide a device for filtering leaves and debris from the rain fall as it moves through a rain gutter and downspout. The present invention provides a simple filter which is easily installed. The filter of the present invention is a hollow, perforated sphere with a diameter slightly less than the width of a normal rain gutter.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
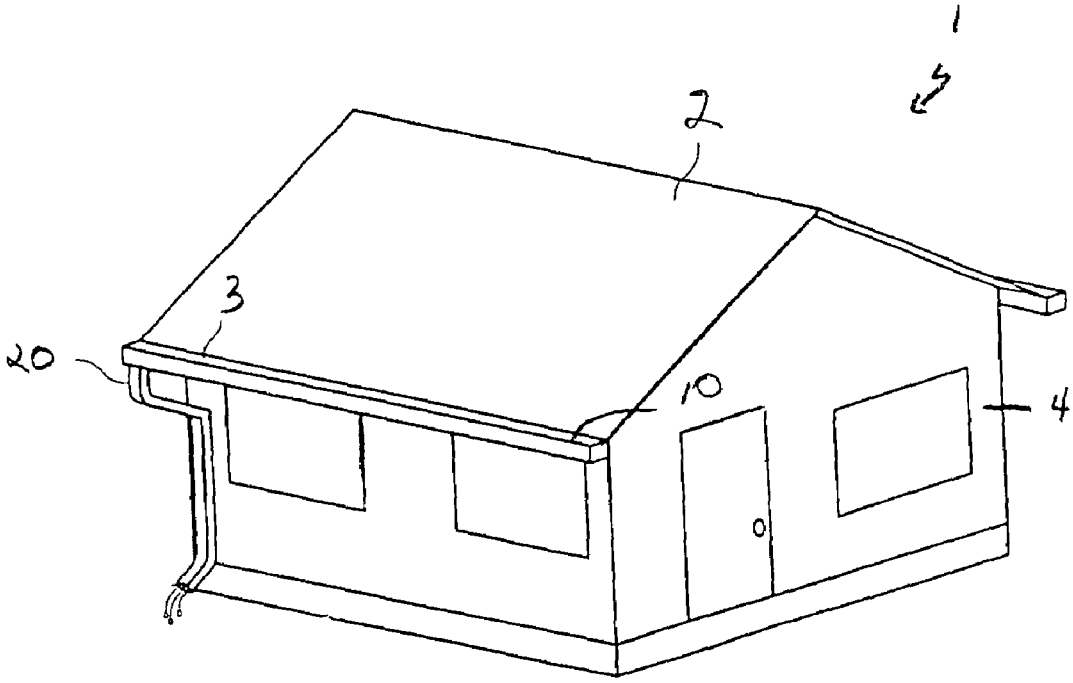
FIG. 1 is a perspective view of a house with a typical rain gutter and downspout.
Figure 2:
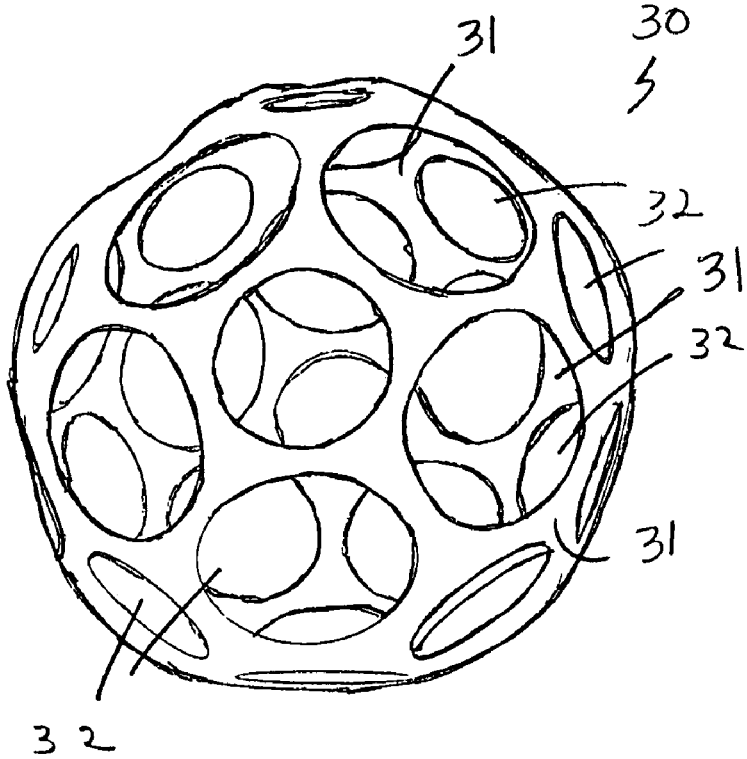
FIG. 2 is a perspective view of one embodiment of the gutter filtering device of the present invention.
Figure 3:
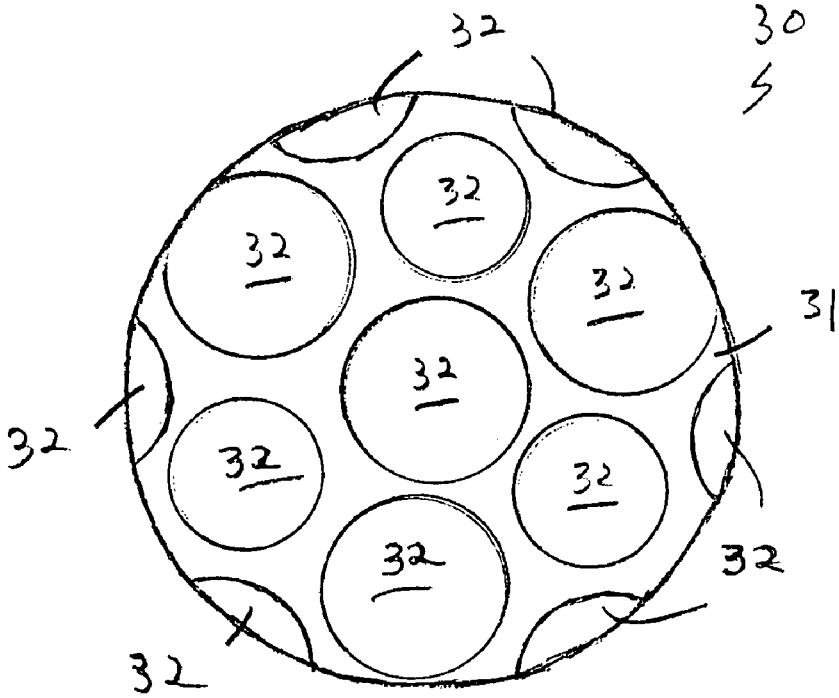
FIG. 3 is a front elevational view of an embodiment of the present invention.
Figure 4:
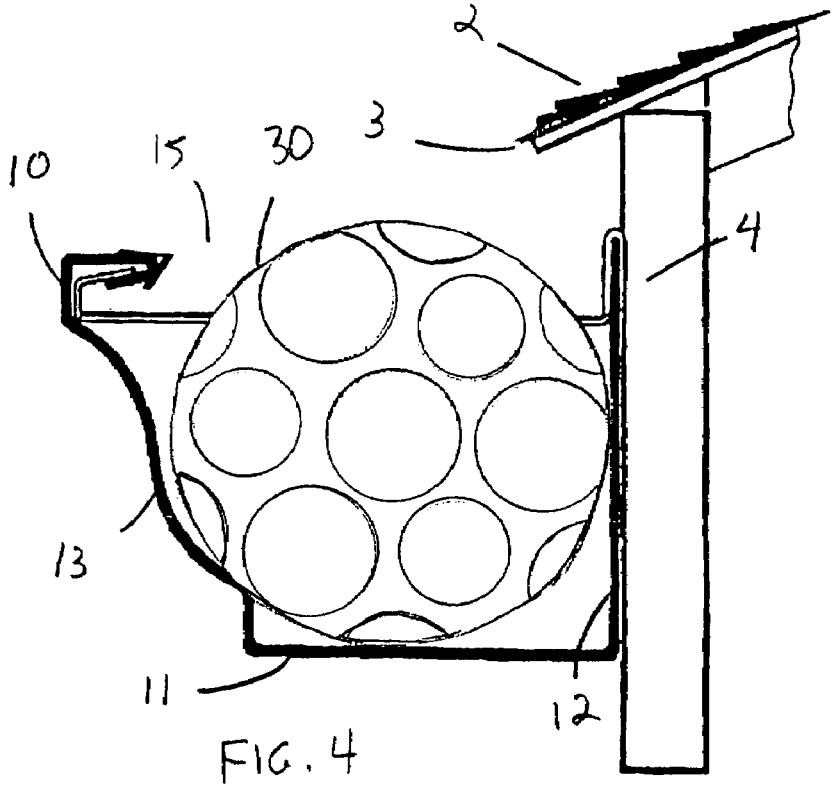
FIG. 4 is a side view of the invention placed in a rain gutter.
Figure 5:
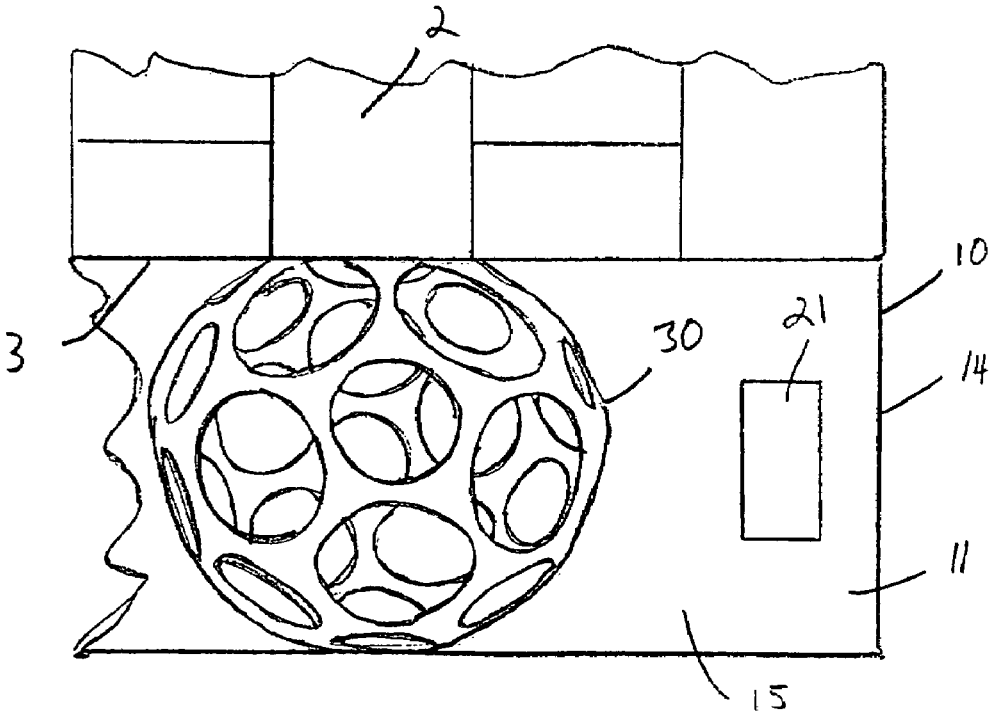
FIG. 5 is a top view of the invention placed in a rain view, partly in section.

Referring to the drawings in detail wherein like elements are indicated by like numerals, there is shown a house 1 with a roof 2 having a rain gutter 10 installed just below the roof edge 3. The rain gutter 10 will have one or more downspouts 20. A typical rain gutter 10 will have a generally flat floor 11 with a rear 12 and a forward 13 wall, said floor, rear and forward walls defining a gutter opening 15. The gutter rear wall 12 is adjacent a house fascia board or wall 4 immediately below of slightly beneath the roof edge 3. The forward wall 13 is positioned outside the roof edge 3 and deflects water and debris coming off the roof 2 over the roof edge 3 into the gutter opening 15. Downspouts 20 are connected to the gutter floor 11, either at one end 14 or both ends. The downspouts have entries 21 fluidly open to the gutter floor 11. The gutter floor 11 is typically angled so that water will flow toward the downspout entries 21.

As rain and snow fall onto the house roof 1, the water therefrom flows into the gutter 10. The water in the gutter then drains out of the gutter through the downspouts 20. Debris, such as leaves, pine needles, small branches, twigs, and the like, are washed off of the roof 2 into the gutter 10 and down into and through the downspouts 20. However, the debris often gathers about the entry 21 to the downspout 20, clogging the drainage and backing up the water. The result is water overflowing the gutter 10 and draining across the house walls 4 and house foundation 5, often damaging the house structure itself.

It has been common in the prior art to provide mesh filters in gutters 10 and/or mesh caps over downspout entries 21 to prevent clogging. However, the fine gauge of prior art mesh is easily clogged as the openings to pass water are typically small. This defeats the purpose of the mesh filters and caps. Installation of the mesh is also difficult and expensive.

The present invention is comprised of a hollow filter sphere 30 having a spherical wall 31 with a plurality of apertures 32 formed therein. The spherical wall 31 is comprised of a water-impervious and weather-resistant material such as a heavy plastic. The apertures 32 are generally round, each aperture preferably having a diameter of one inch or more. The purpose of the filter sphere 30 is to allow smaller debris to pass through, the smaller debris less likely to cause a clog as it enters and passes through the downspout. The filter sphere 30 may have apertures 32 of differing sizes, to enable some debris of differing sizes to pass through. The filter sphere wall 31 may be made from a resilient material allowing the filter sphere 30 to be deformed to fit into rain gutters of varying configurations. The filter sphere 30 preferably has a diameter slightly less than the distance between gutter the rear wall 12 and gutter forward wall 13, thereby permitting the filter sphere 30 to fit snugly within a gutter opening 15. The filter sphere diameter is greater than the downspout entry 21.

In operation, the filter sphere 30 is placed into a gutter opening 15, typically wedging itself between the gutter walls 12, 13 and gutter floor 11. The filter sphere 30 may literally be thrown up and into the gutter opening 15. The preferred placement of the filter sphere 30 within the gutter opening 15 is between 12 and 18 inches from a gutter end 14. The downspout entry 21 resultant position would then be between the filter sphere 30 and the gutter end 14. Optionally, the filter sphere 30 may be placed directly over the downspout entry 21. However, applicant has found that superior water flow is maintained by positioning the filter sphere away from the downspout entry 21. The round cross-sectional shape of the filter sphere 30 permits water to flow through and about the filter sphere 30 even as the filter sphere backs up gutter debris.

It is understood that the above-described embodiment is merely illustrative of the application. Other embodiments may be readily devised by those skilled in the art which will embody the principles of the invention and fall within the spirit and scope thereof.

I claim:

1. In combination with a rain gutter attached below the roof edge of a house, said rain gutter having a generally flat floor with a rear wall, a forward wall, and two opposite ends, said floor, rear and forward walls defining a gutter opening, said rain gutter having a plurality of downspouts each connected to the gutter floor near a gutter end, said downspouts having entries fluidly open to the gutter floor, a plurality of filter spheres each comprising:

a spherical wall;

a plurality of apertures formed in said spherical wall;

wherein each spherical wall has a diameter less than a distance between the gutter rear wall and the gutter forward wall;

wherein each spherical wall has a diameter greater than a downspout entry;

wherein each filter sphere is positioned within said gutter opening.

2. A hollow filter sphere as recited in claim 1, wherein:

the spherical wall is comprised of a water-impervious and weather-resistant material.

3. A hollow filter sphere as recited in claim 2, wherein:

the apertures are generally round, each aperture having a diameter of at least one inch.

4. A hollow filter sphere as recited in claim 3, wherein:

a portion of the plurality of apertures have sizes different than a remaining plurality of apertures.

5. A hollow filter sphere as recited in claim 4, wherein:

the filter sphere wall is comprised of a resilient material.

6. A hollow filter sphere as recited in claim 5, wherein:

the filter sphere within the gutter opening is positioned between 12 and 18 inches from a gutter end, said downspout entry having a resultant position between the filter sphere and a gutter end.

7. A hollow filter sphere as recited in claim 5, wherein:

the filter sphere is placed directly over a downspout entry.

* * * * *